US006364139B1

(12) United States Patent
Chen

(10) Patent No.: US 6,364,139 B1
(45) Date of Patent: Apr. 2, 2002

(54) TWO-PART SHELF-HOLDER FOR SECTIONAL RACK

(75) Inventor: Henry Chen, Taipei (TW)

(73) Assignee: Pro Trend Co., Ltd., Taipei (TW)

( * ) Notice: Subject to any disclaimer, the term of this patent is extended or adjusted under 35 U.S.C. 154(b) by 0 days.

(21) Appl. No.: 09/704,401

(22) Filed: Oct. 31, 2000

(51) Int. Cl.[7] ..... A47B 57/00

(52) U.S. Cl. ..... 211/187; 211/181.1; 108/107; 108/147.12; 248/245

(58) Field of Search ..... 211/187, 181.1; 108/107, 147.11, 147.12, 147.14, 147.15, 147.18, 106; 403/373; 248/243, 244, 245

(56) References Cited

U.S. PATENT DOCUMENTS 4,750,626 A * 6/1988 Nicely ..... 211/187
5,415,302 A * 5/1995 Carlson et al. ..... 211/187
5,531,167 A * 7/1996 Stevens et al. ..... 108/106
5,924,581 A * 7/1999 Chen ..... 211/187
6,079,575 A * 6/2000 Wang ..... 211/187

* cited by examiner

*Primary Examiner*—Curtis A. Cohen
*Assistant Examiner*—Erica B. Harris
(74) *Attorney, Agent, or Firm*—W. Wayne Liauh

(57) ABSTRACT

A two-part shelf-holder for supporting shelves on connecting members fixed around vertical posts of a sectional rack. The shelf-holder includes a fixed part fixedly connected at one end to a corner of the shelf and a movable part pivotally connected at one end to the fixed part via a vertical pivotal shaft. The fixed part is formed at another end with a curved case defining a side opening. The movable part is formed at another end with a curved cover adapted to close the side opening of the case. A free end of the case is formed of a dovetail mortise and a free end of the cover is formed of a dovetail tenon for fitly engaging with the dovetail mortise of the case. Two ends of the pivotal shaft are extended through two long holes provided on upper and lower sides of the movable part, so that the movable part could be moved linearly relative to the fixed part to engage or disengage the dovetail tenon with or from the dovetail mortise so as to close or open the two parts of the shelf-holder.

2 Claims, 10 Drawing Sheets

TWO-PART SHELF-HOLDER FOR SECTIONAL RACK

BACKGROUND OF THE INVENTION

The present invention relates to a two-part shelf-holder for sectional rack, and more particularly to a two-part shelf-holder that may be quickly opened and closed to mount around or dismount from a vertical post of the rack, so that a shelf or a horizontal support associated with the shelf-holder may be quickly mounted onto or dismounted from the vertical post.

Conventional sectional racks in the early stage required fastening means and tools to erect or disassemble the racks. However, improvements have been made to such sectional racks and fastening means and tools are no longer needed in the erection and disassembling thereof. FIG. 1 illustrates one of these improved sectional racks. As shown, the rack includes vertical posts 10 having a plurality of horizontally spaced annular grooves 13 provided on their outer surfaces, and shelves 12 connected to the vertical posts 10 through two-part connecting members 11. The two parts of the connecting member 11 maybe opened or closed relative to each other. Aradially inward projected rib 14 is annularly provided along an inner surface of the connecting member 11 at proper position, such that when the two parts of the connecting member 11 are in a closed position, it may be put around the vertical post 10 at a predetermined position by engaging the rib 14 with one of the grooves 13. The connecting member 11 in the closed position has a downward and outward inclined outer surface, making it look like a truncated cone. The shelf 12 has short sleeves 15 provided at four corners thereof (only one corner is shown in FIG. 1). Each sleeve 15 has a downward and outward inclined inner surface corresponding to the inclined outer surface of the connecting member 11. The sleeves 15 are separately put around the connecting members 11 mounted on the vertical posts 10 to, on the one hand, force the connecting members 11 toward the vertical posts 10 and, on the other hand, connect the shelves 12 to the vertical posts 10.

In the above-described sectional rack, each shelf 12 is connected to the vertical posts 10 by putting four sleeves 15 thereof around four connecting members 11 mounted on the posts 10. If it is intended to increase or decrease the number of shelves 12 of the rack, it is necessary to temporarily remove the top shelf 12 from the rack before other layers of shelves 12 could be adjusted. This is, of course, inconvenient for the user to do so.

U.S. Pat. Nos. 5,676,263; 5,303,645; 5,174,676; 4,991,725; 4,799,818; 4,595,107; 4,546,887 and 4,763,799 all refer to the above-mentioned types of sectional racks.

U.S. Pat. No. 5,924,581 entitled "Easy-mount Shelf Holder for A Sectional Rack" granted to the applicant of the present invention discloses an openable shelf holder that enables a shelf to be sideward connected to vertical posts of the rack without the need of mounting from a top of the posts. This design also allows adjustment of a number of shelves on the rack without the need of dismounting the rack. However, the shelf holder disclosed in U.S. Pat. No. 5,924,581 includes complicated structure to prevent two parts of the shelf holder forming a complete and closed sleeve from separating from each other when the sleeve is put around the connecting member to press the latter against the vertical post. Such complicate structure increases the difficulty and, accordingly, the cost in manufacturing the rack.

It is therefore the intention of the inventor to provide a two-part shelf-holder for sectional racks to eliminate the drawbacks in the conventional shelf holders for sectional racks, including that disclosed in U.S. Pat. No. 5,924,581.

SUMMARY OF THE INVENTION

A primary object of the present invention is to provide a two-part shelf-holder for connecting a shelf or a horizontal support to vertical posts of a sectional rack in a more convenient manner to enable easy increase or decrease of the number of shelves on the rack.

Another object of the present invention is to provide a two-part shelf-holder for connecting a shelf or a horizontal support to vertical posts of a sectional rack, and the two-part shelf-holder has simple structure and could be easily manufactured at low cost.

To achieve the above and other objects, the two-part shelf-holder of the present invention for supporting shelves on connecting members fixed around vertical posts of a sectional rack mainly includes a fixed part fixedly connected at one end to a corner of the shelf and a movable part pivotally connected at one end to the fixed part via a vertical pivotal shaft. The fixed part is formed at another end with a curved case defining a side opening. The movable part is formed at another end with a curved cover adapted to engage with the side opening of the case. A free end of the case is formed of a dovetail mortise and a free end of the cover is formed of a dovetail tenon for fitly engaging with the dovetail mortise of the case. The pivotal shaft extends two ends through two long holes provided on upper and lower sides of the movable part, so that the movable part could, on the one hand, be guided by the long holes to move inward or outward relative to the fixed part and, on the other hand, be turned about the pivotal shaft relative to the fixed part. When the cover of the movable part is turned to close the case of the fixed part with the dovetail tenon engaged with the dovetail mortise, a complete and closed sleeve is formed for firmly locating around and downward pressing against one connecting member on the vertical post.

The fixed part of the two-part shelf-holder of the present invention could also be fixedly connected at one end to an end of a horizontal support of the sectional rack.

When the movable part of the two-part shelf-holder is moved forward for the pivotal shaft to abut on an end of the long holes away from the cover, the dovetail tenon sideward disengages from the dovetail mortise to allow the movable part to pivotally turn away from the fixed part to open the shelf-holder. And, when the movable part of the shelf-holder is moved rearward or inward for the pivotal shaft to abut on an end of the long holes facing the cover, the dovetail tenon is sideward moved into the dovetail mortise to allow the movable part and the fixed part to form a closed, sleeve-like shelf/holder.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 4:
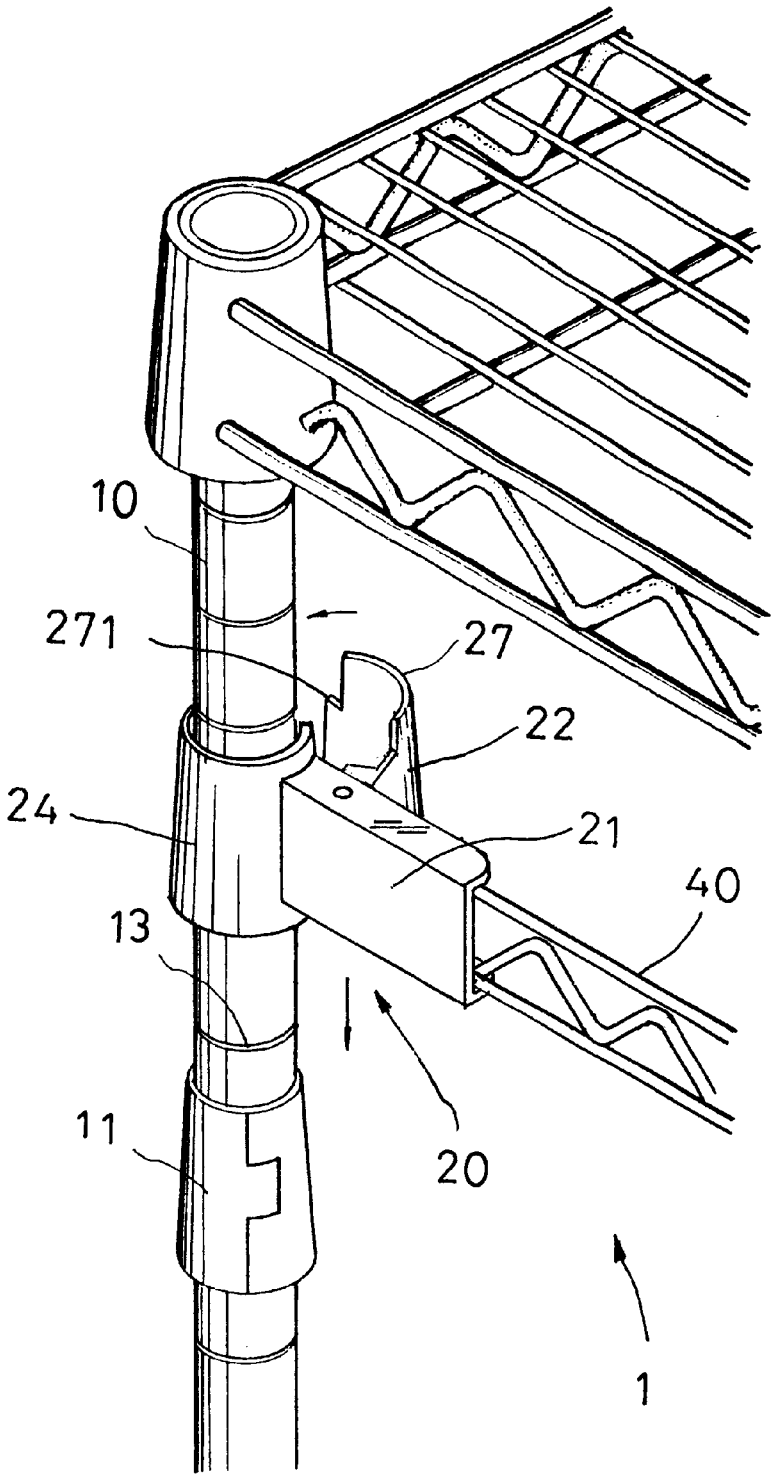
FIG. 4 shows the manner of assembling the two-part shelf-holder of FIG. 2 to a vertical post of the sectional rack.

Please first refer to FIG. 4 in which a part of a sectional rack 1 assembled from a plurality of vertical posts 10, connecting members 11, shelves 30 and horizontal supports 40 is shown. Each vertical post 10 is provided around an outer surface with a plurality of horizontally spaced grooves 13 or through holes (not shown). Each connecting member 11 is adapted to internally engage with one of the groove 13 to fix onto the vertical post 10 and has an upward tapered outer wall surface. The shelves 30 and the horizontal supports 40 are connected to the vertical posts 10 through two-part shelf-holders 20 of the present invention provided at their corners or outer ends.

Figure 1:
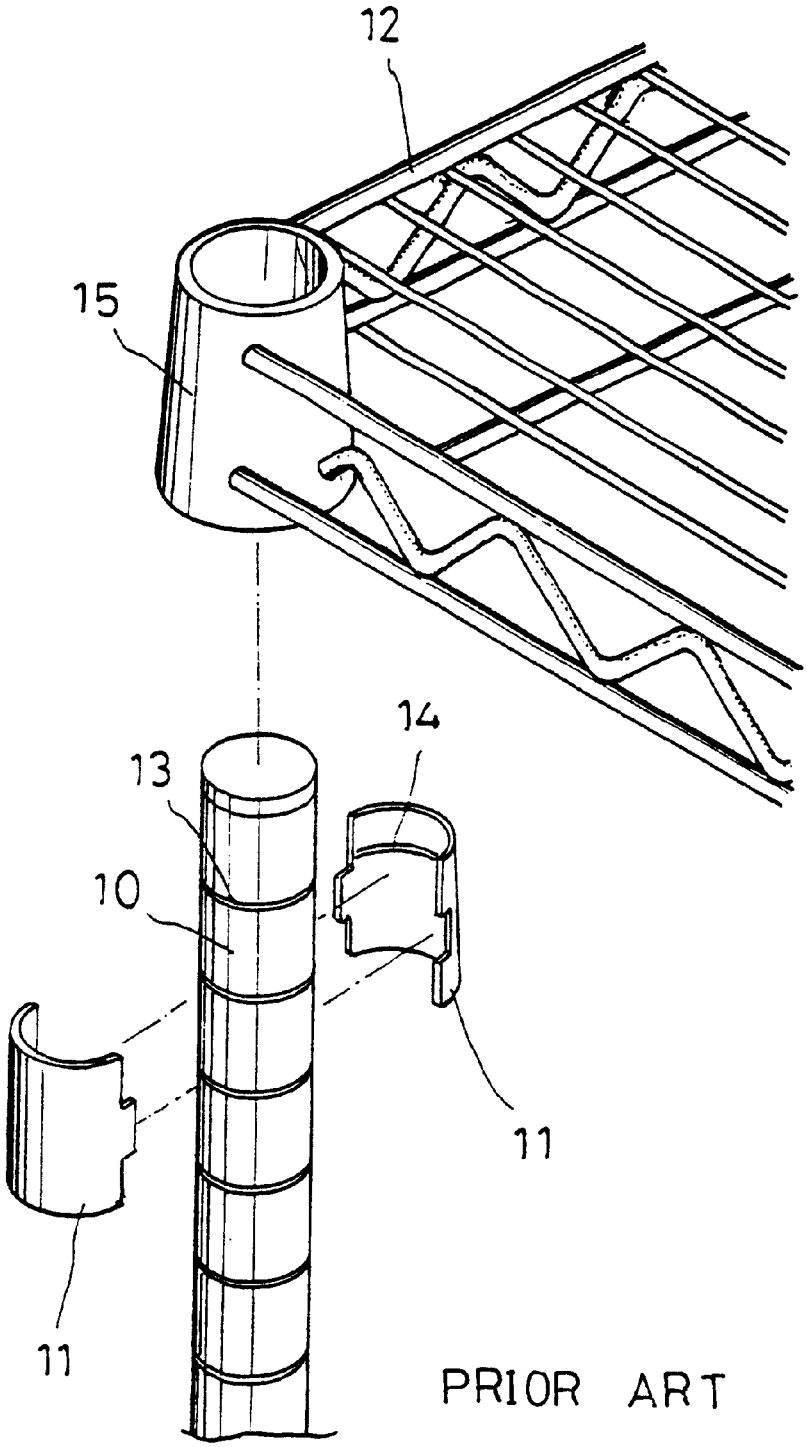
FIG. 1 is an exploded perspective of a conventional sectional rack.
Figure 2:
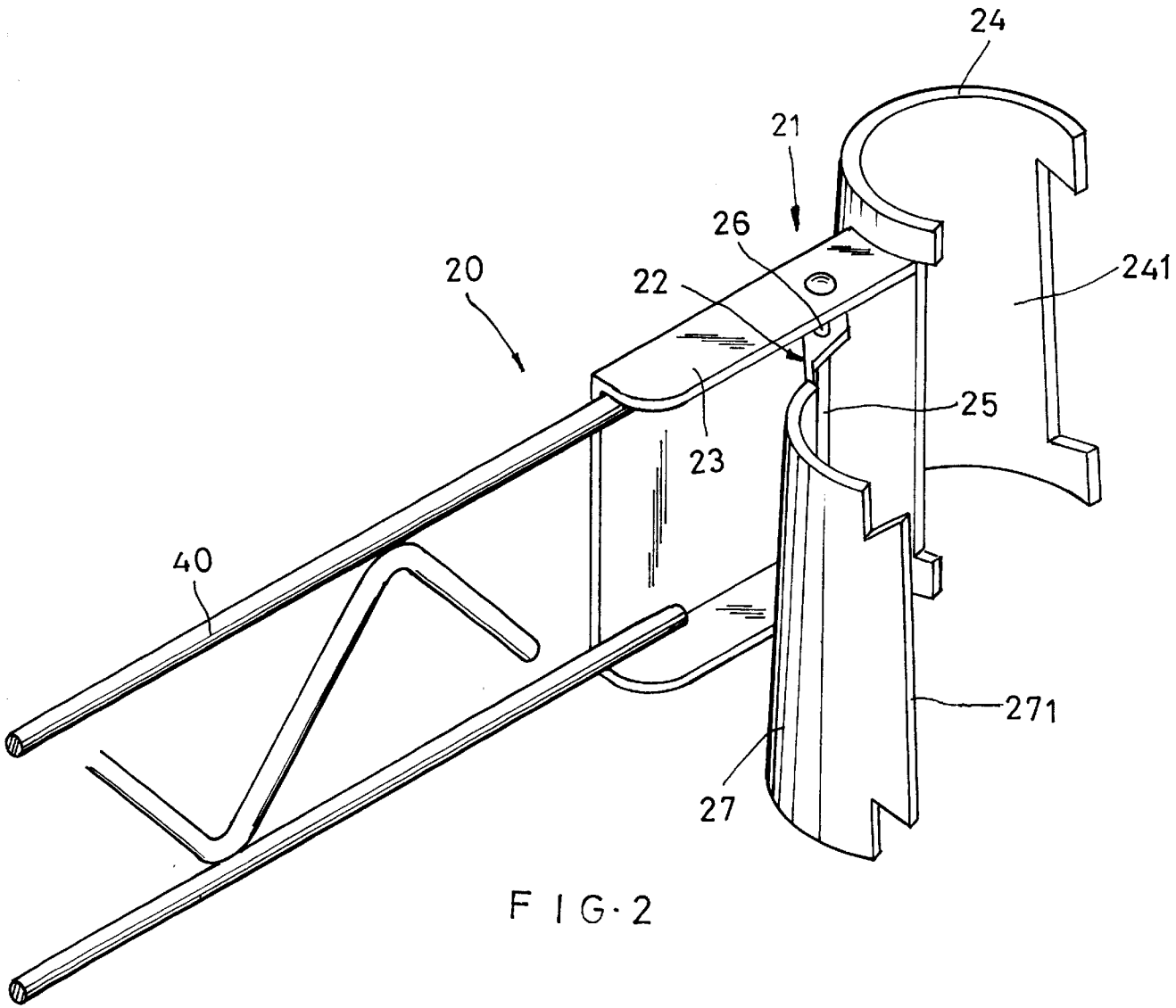
FIG. 2 is an enlarged perspective of a two-part shelf-holder for a sectional rack according to the present invention in an opened state.

Please now refer to FIG. 2 in which a two-part shelf-holder 20 according to a preferred embodiment of the present invention is shown. As shown, the shelf-holder 20 mainly includes a fixed part 21 and a movable part 22 pivotally connected to the fixed part 21.

Figure 8:
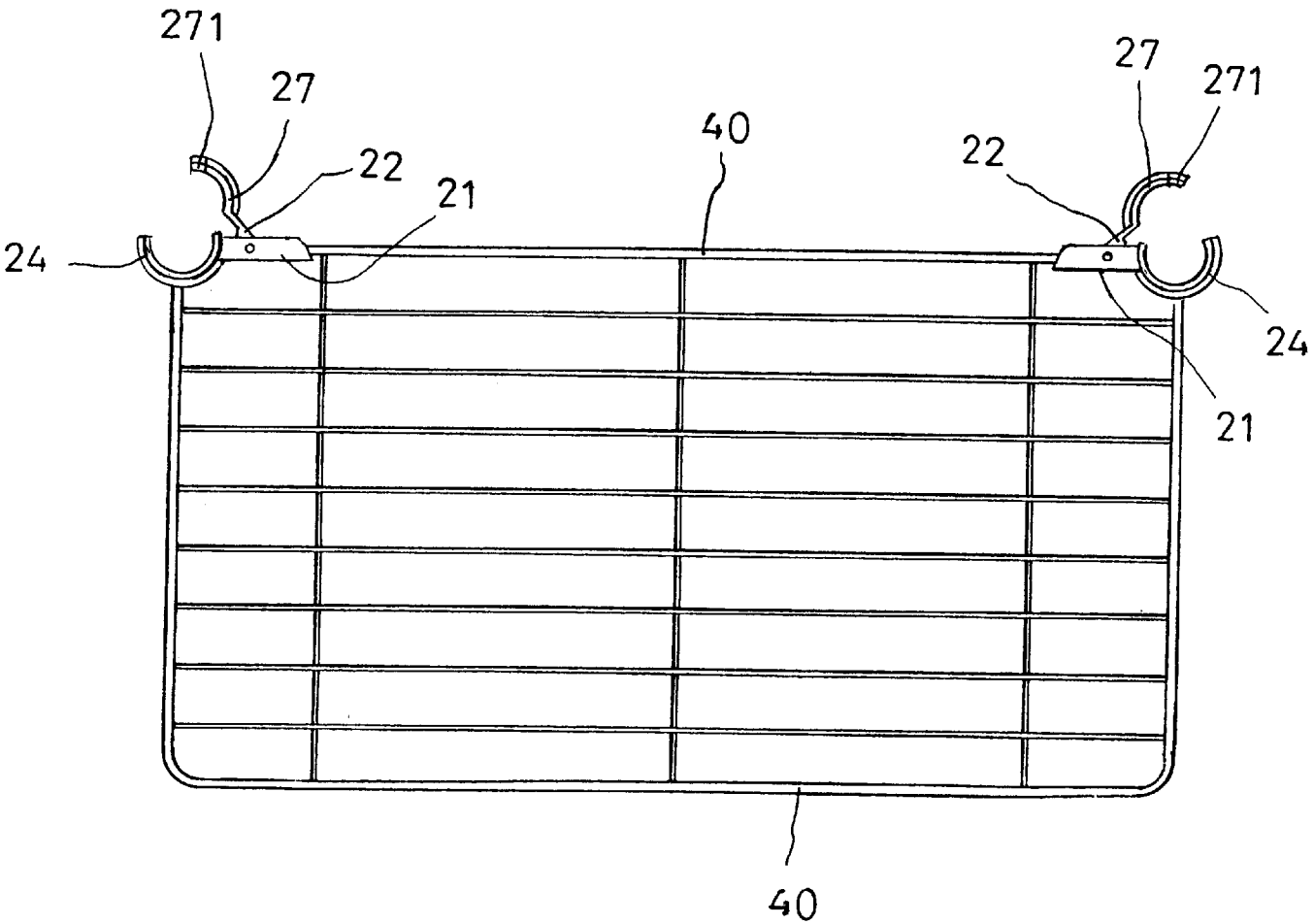
FIG. 8 is a plan view of a shelf for a sectional rack having the two-part shelf-holders of the present invention connected to two corners thereof.
Figure 9:
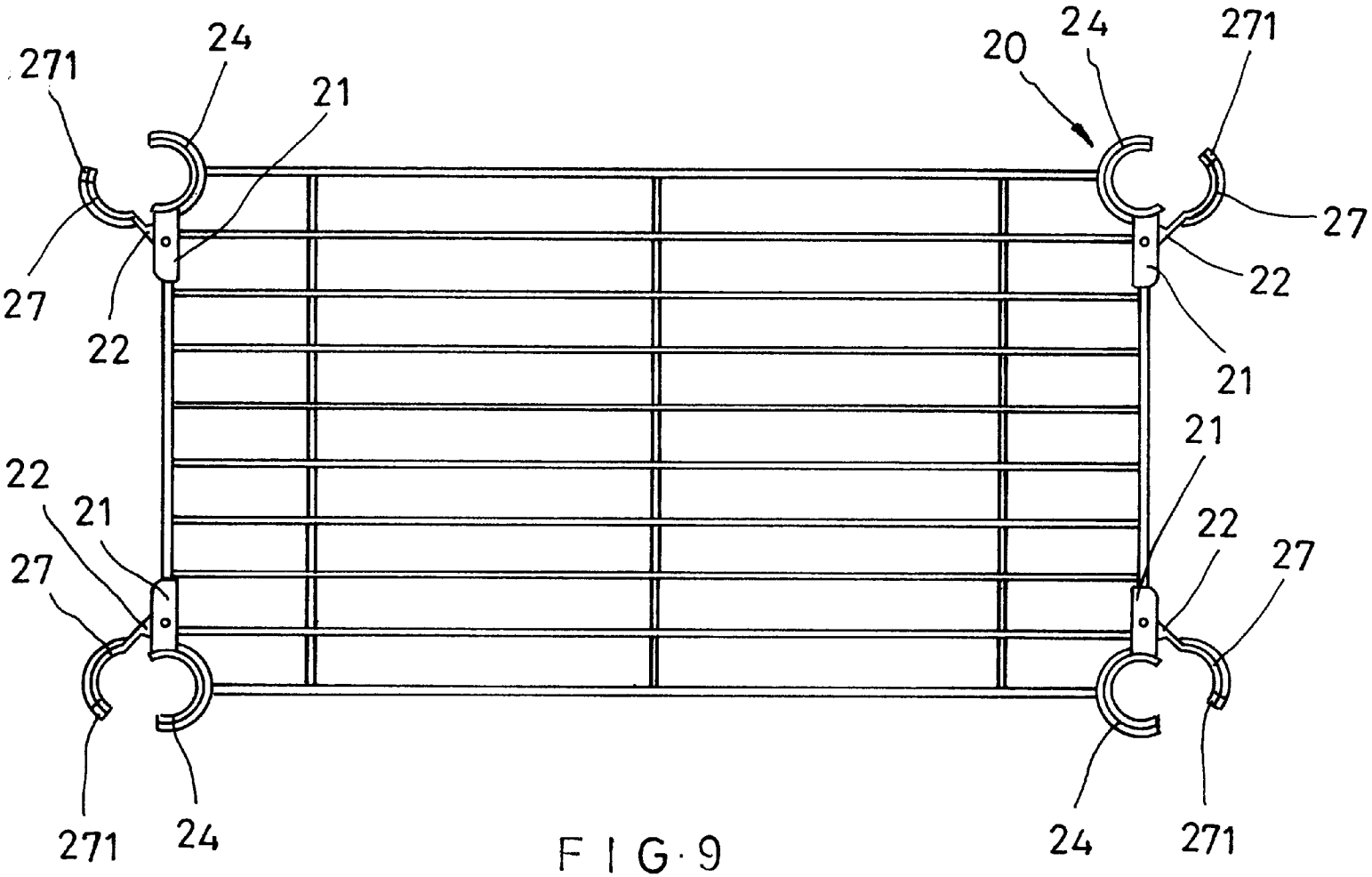
FIG. 9 is a plan view of a shelf for a sectional rack having the two-part shelf-holders of the present invention connected to four corners thereof.

The fixed part 21 includes a horizontally extended arm portion 23 and a curved case 24 fixedly connected to an end of the arm portion 23. The fixed part 21 is fixedly connected to an end of a horizontal support 40, as shown in FIG. 2, or to a corner of a shelf 30, as shown in FIGS. 8 and 9, via thearmportion 23. The curvedcase24 defines a side opening 241 that has a width larger than an outer diameter of the vertical post 10.

The movable part 22 is pivotally connected to the fixed part 21 via a pivotal shaft 25, two ends of which are extended through a pair of through holes 26 provided at upper and lower sides of the movable part 22 to vertically and fixedly connected to upper and lower sides of the arm portion 23 of the fixed part 21. The movable part 22 includes a forward extended curved cover 27 that is adapted to cover the side opening 241 of the curved case 24 to together with the curved case 24 form a complete and closed sleeve for locating around and pressing the connecting member 11 against the vertical post 10.

Figure 3:
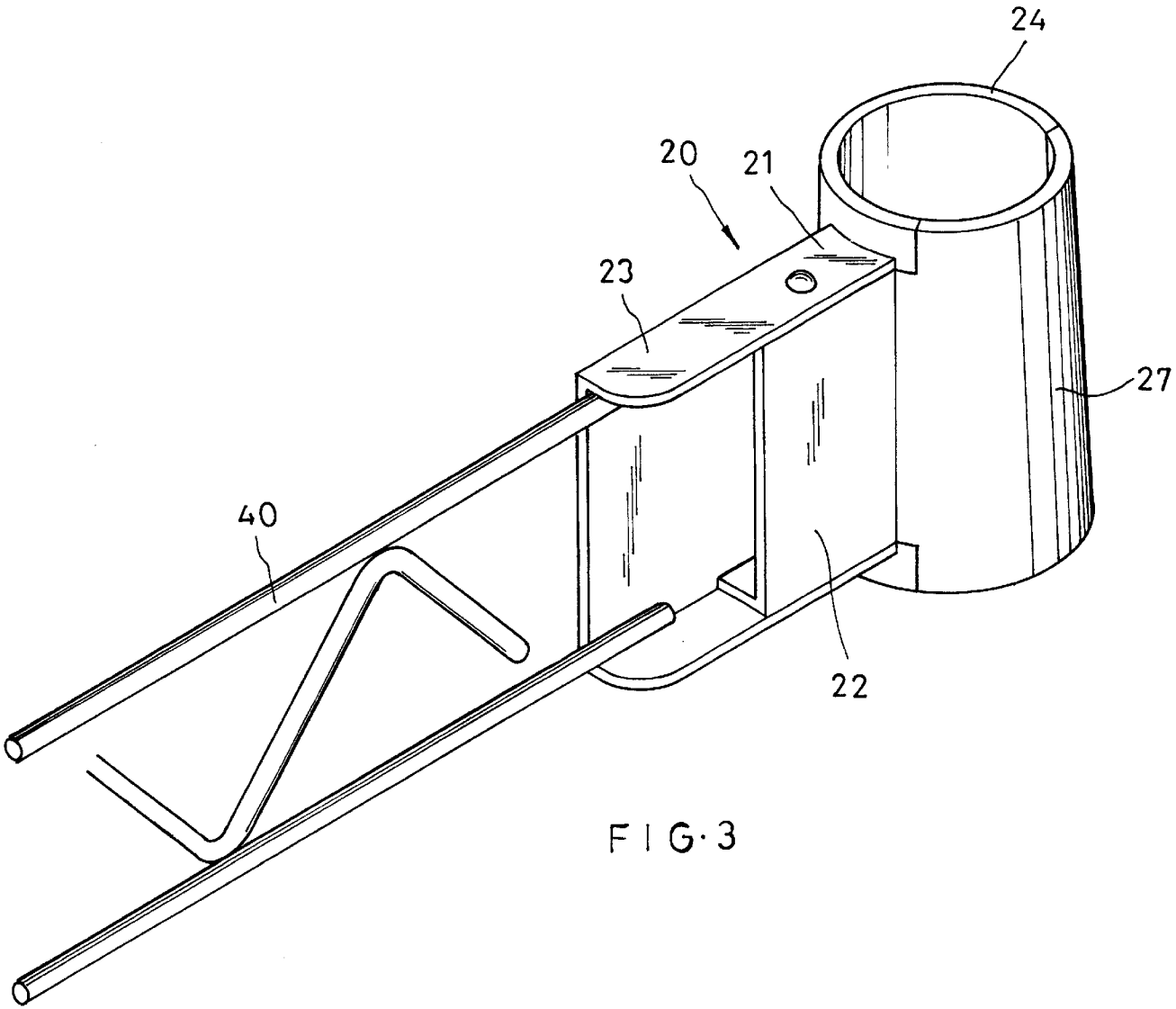
FIG. 3 is an enlarged perspective of the two-part shelf-holder of FIG. 2 in a closed state.
Figure 5:
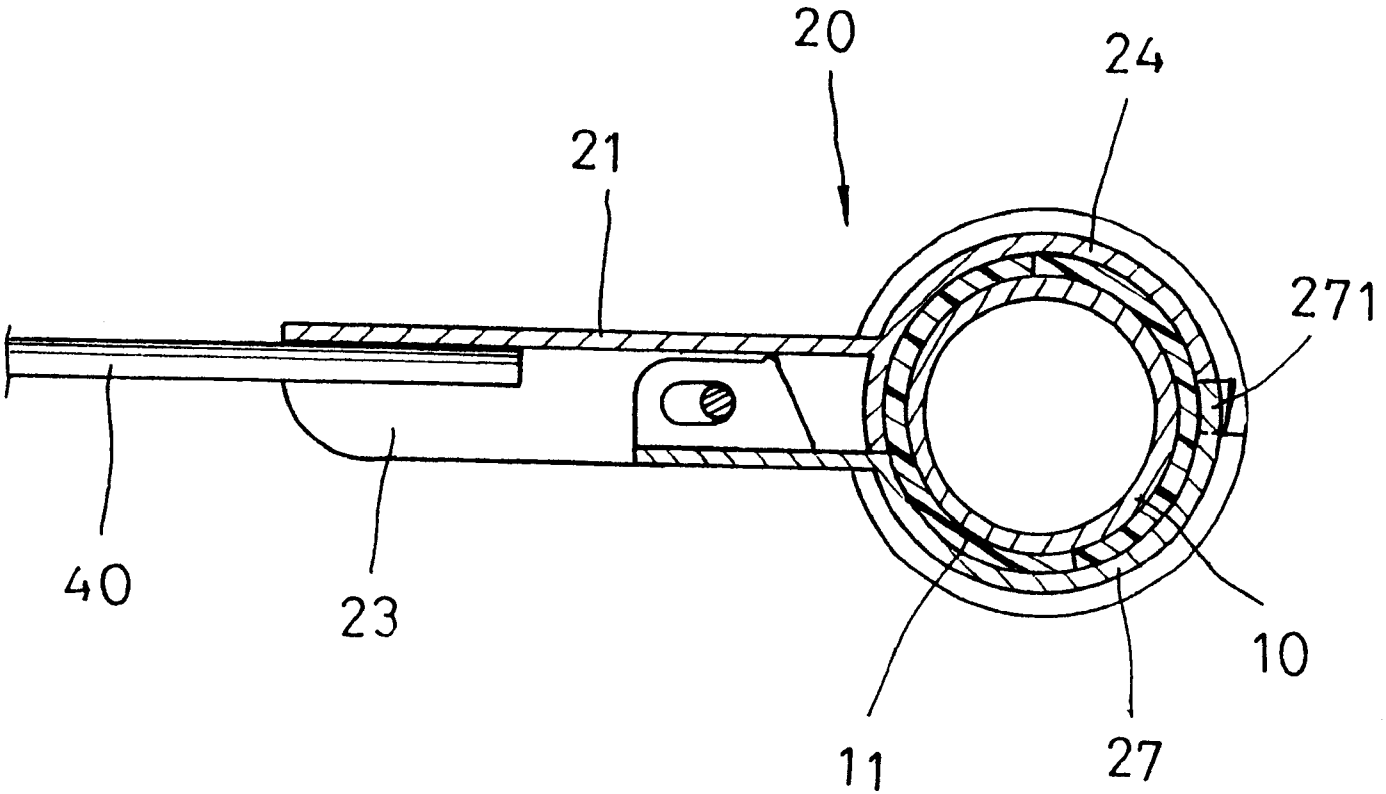
FIG. 5 is a cross sectional view showing how the shelf-holder of FIG. 2 presses a two-part connecting member against the vertical post of the sectional rack.
Figure 6:
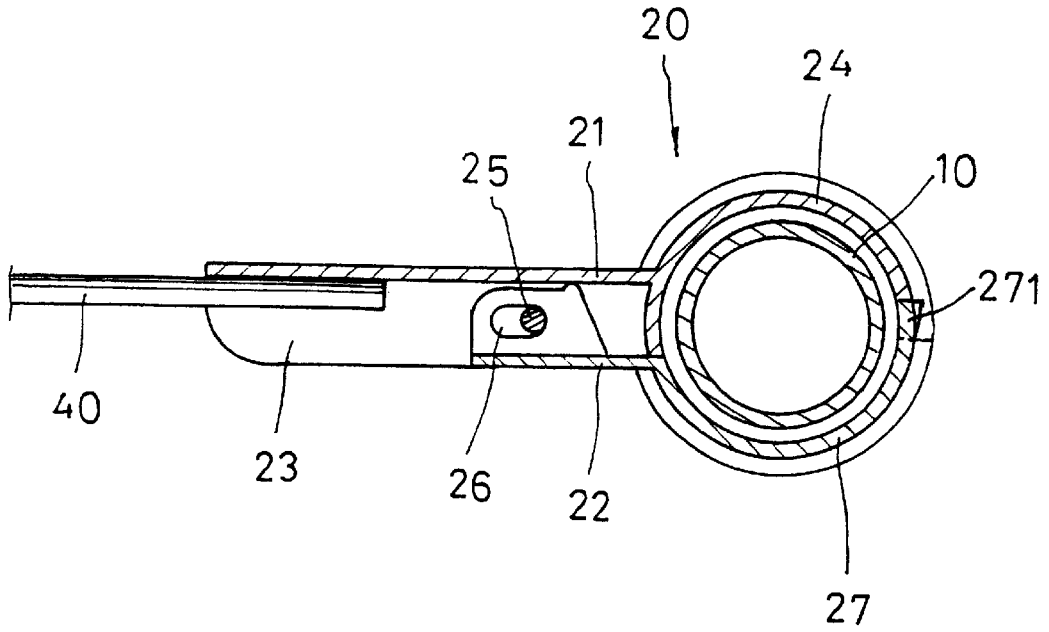
FIG. 6 is a cross sectional view showing that two parts of the shelf-holder of FIG. 2 are fully closed to enclose the vertical post in the shelf-holder.
Figure 7:
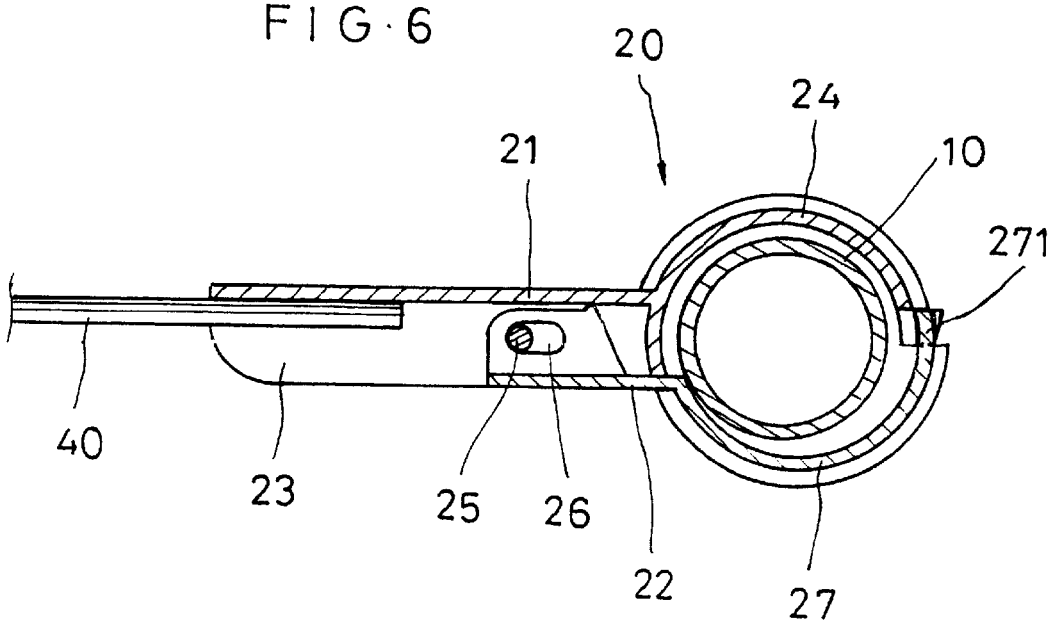
FIG. 7 is a cross sectional view showing that two parts of the shelf-holder of FIG. 2 are sideward separated from one another.

The above-described two-part shelf-holder 20 is characterized in that the two through holes 26 provided on the movable part 22 are lengthwise extended long holes, as can be clearly seen in FIG. 5, 6 and 7, to allow the movable part 22 to move inward or outward relative to the fixed part 21 and to pivotally turn about the pivotal shaft 25, and that the cover 27 of the movable part 22 is formed at a free end with a dovetail tenon 271 and the case 24 of the fixed part 21 is formed at a free end with a dovetail mortise 242 corresponding to the dovetail tenon 271, so that the cover 27 covers the side opening 241 of the case 24 with the dovetail tenon 271 fitly engaging with the dovetail mortise 242, as shown in FIG. 3.

With the long holes 26, the movable part 22 is allowed to move inward or outward relative to the fixed part 21 and to rotate about the pivotal shaft 25. When the movable art 22 is pivotally turned about the pivotal shaft 25 for the cover 27 to locate in front of the side opening 241 on the case 24 of the fixed part 21, the movable part 22 is then be moved inward relative to the fixed part 21 so that the pivotal shaft 25 abuts on outer ends of the long holes 26 that face toward the cover 27, the dovetail tenon 271 is moved into the dovetail mortise 242 to form a closed shelf-holder, as shown in FIG. 6. And, when the movable part 22 is moved outward relative to the fixed part 21 so that the pivotal shaft 25 abuts against inner ends of the long holes 26 that face away from the cover 27, the dovetail tenon 271 sideward disengages from the dovetail mortise 242 and the cover 27 could be turned about the pivotal shaft 25 to move away from the case 24 and open the closed shelf-holder, as shown in FIG. 7.

Please refer back to FIG. 4. To connect the two-part shelf-holder 20 of the present invention to the vertical post 10, first turn the movable part 22 away from the fixed part 21 until an open angle between the cover 27 and the case 24 is maximized. At this point, the case 24 of the fixed part 21 could be moved toward the vertical post 10 for the latter to locate in the case 24 via the side opening 241. Then, turn the movable part 22 toward the fixed part 21 and move the movable part 22 inward relative to the fixed part 21 for the dovetail tenon 271 to engage with the dovetail mortise 242 to form a complete sleeve to enclose the vertical post 10 in the shelf-holder 20, as shown in FIG. 6. Thereafter, move the shelf-holder 20, and accordingly, the shelf 30 or the horizontal support 40 to which the shelf-holder 20 is connected, downward onto a connecting member 11 that has been engaged with one groove 13 on the vertical post 10, as shown in FIG. 5. The shelf 30 or the horizontal support 40 is then stopped by the connecting member 11 from moving any further and is fixed on the vertical post 10 at the connecting member 11.

To disconnect the shelf 30 or the horizontal support 40 from the vertical post 10 of the sectional rack 1, simply reverse the above-described procedures. It is apparent that the shelf 30 and the horizontal support 40 could be more conveniently and quickly assembled to and disassembled from the vertical post 10 of the sectional rack 1 when the two-part shelf-holders 20 of the present invention are connected to the corners or the ends of the shelf 30 or the horizontal support 40, respectively.

With the engagement of the dovetail tenon 271 on the cover 27 of the movable part 22 with the dovetail mortise 242 on the case 24 of the fixed part 21, the complete shelf-holder formed from the cover 27 and the case 24 is able to maintain its complete shape without becoming separated when the shelf-holder 20 is firmly pressed against the connecting member 11 to restrain the latter on the vertical post 10.

The case 24 and the cover 27 are so designed that the complete shelf-holder formed from them has an upward tapered inner wall surface corresponding to the upward tapered outer wall surface of the connecting member 11. The contact of these upward tapered surfaces with each other enables tight mounting of the connecting member 11 onto the vertical post 10 by the downward pushed shelf-holder 20.

As can be seen from FIG. 4, the shelf 30 or the horizontal support 40 maybe connected to any position on the vertical post 10 of the sectional rack 1 simply by aligning the opened case 24 with the vertical post 10 and then closing the cover 27 to the case 24 to firmly enclose the vertical post 10 in the sleeve 20. The mounting or dismounting of the shelf 30 or the horizontal support 40 to or from the vertical post 10 is not interfered by any other existing shelf 30 or horizontal support 40 on the vertical post 10. That is, a shelf 30 or a horizontal support 40 could be added to or removed from the sectional rack 1 without disassembling any other existing shelves or horizontal supports 40 located above a position at where the shelf 30 or horizontal support 40 is to be added or removed.

As mentioned before, the fixed part 21 of the shelf-holder 20 of the present invention may be connected to two ends of a horizontal support 40 or to two or four corners of a shelf 30, as shown in FIGS. 8 and 9, respectively.

For the two-part shelf-holder 20 of the present invention to work successfully, the following conditions must be met:

1. The side opening 241 on the case 24 of the fixed part 21 of the shelf-holder 20 must have a width larger than an outer diameter of the vertical post 10, and the case 24 is formed at its free end with a dovetail mortise 242.
2. The cover 27 on the movable part of the shelf-holder 20 is adapted to engage with the side opening 241 on the case 24 of the fixed part to provide a complete and closed sleeve, and the cover 27 is formed at its free end with a dovetail tenon 271 for fitly engaging with the dovetail mortise 242 on the case 24.
3. The movable part 22 is provided at one end opposite to the cover 27 with upper and lower long holes through which avertical pivotal shaft 25 is extended to fixedly connect two ends thereof to the arm portion 23 of the fixed part 21.

With the above arrangements, the two-part shelf-holder for a sectional rack according to the present invention is superior to the easy-mount shelf holder for a sectional rack disclosed in the earlier U.S. Pat. No. 5,924,581 granted to the applicant of the present invention, and is more competitive in the market.

Figure 10:
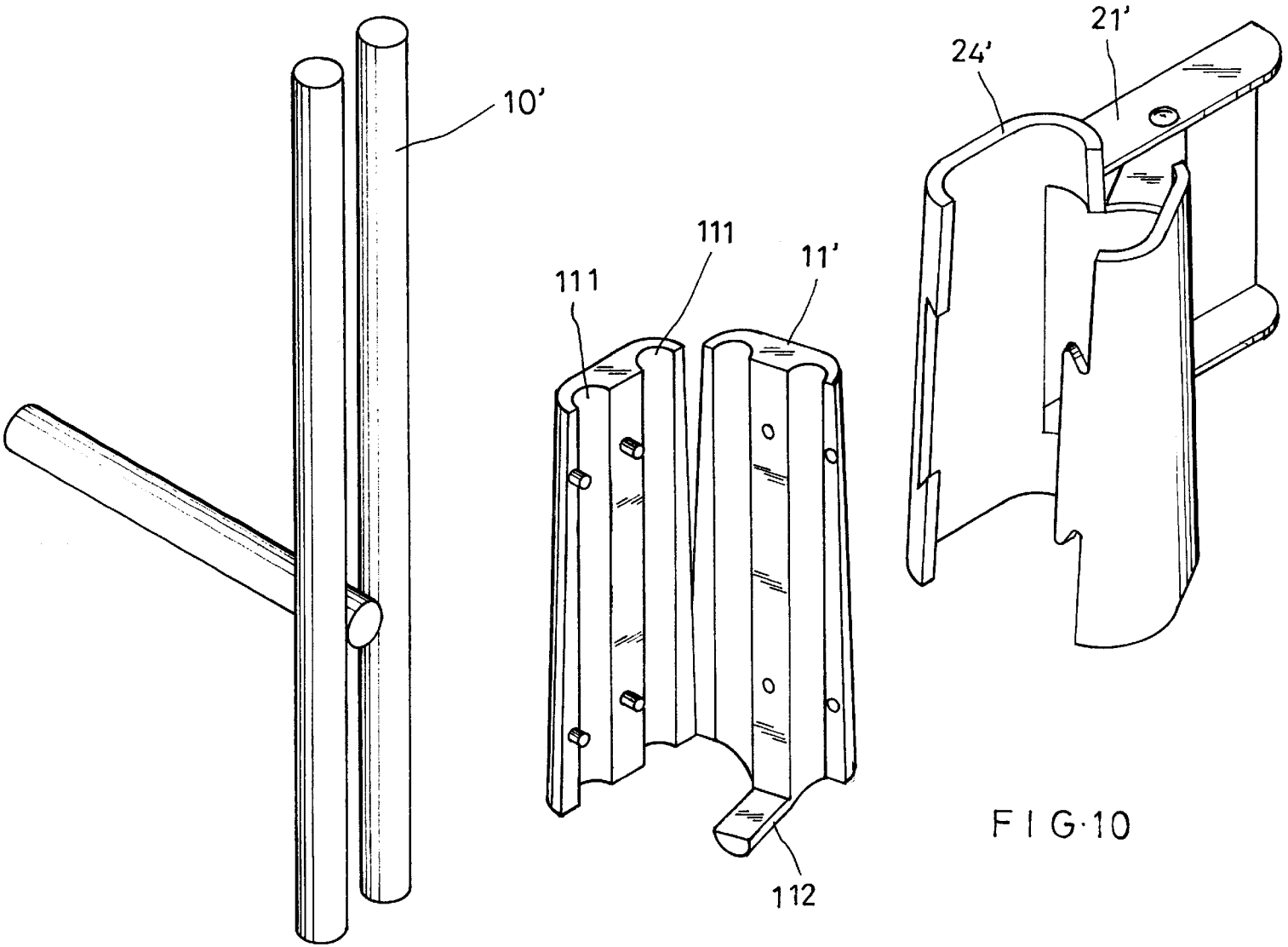
FIG. 10 is an exploded perspective view showing the use of a two-part shelf-holder according to a second embodiment of the present invention with another type of vertical post and connecting member for sectional rack.
Figure 11:
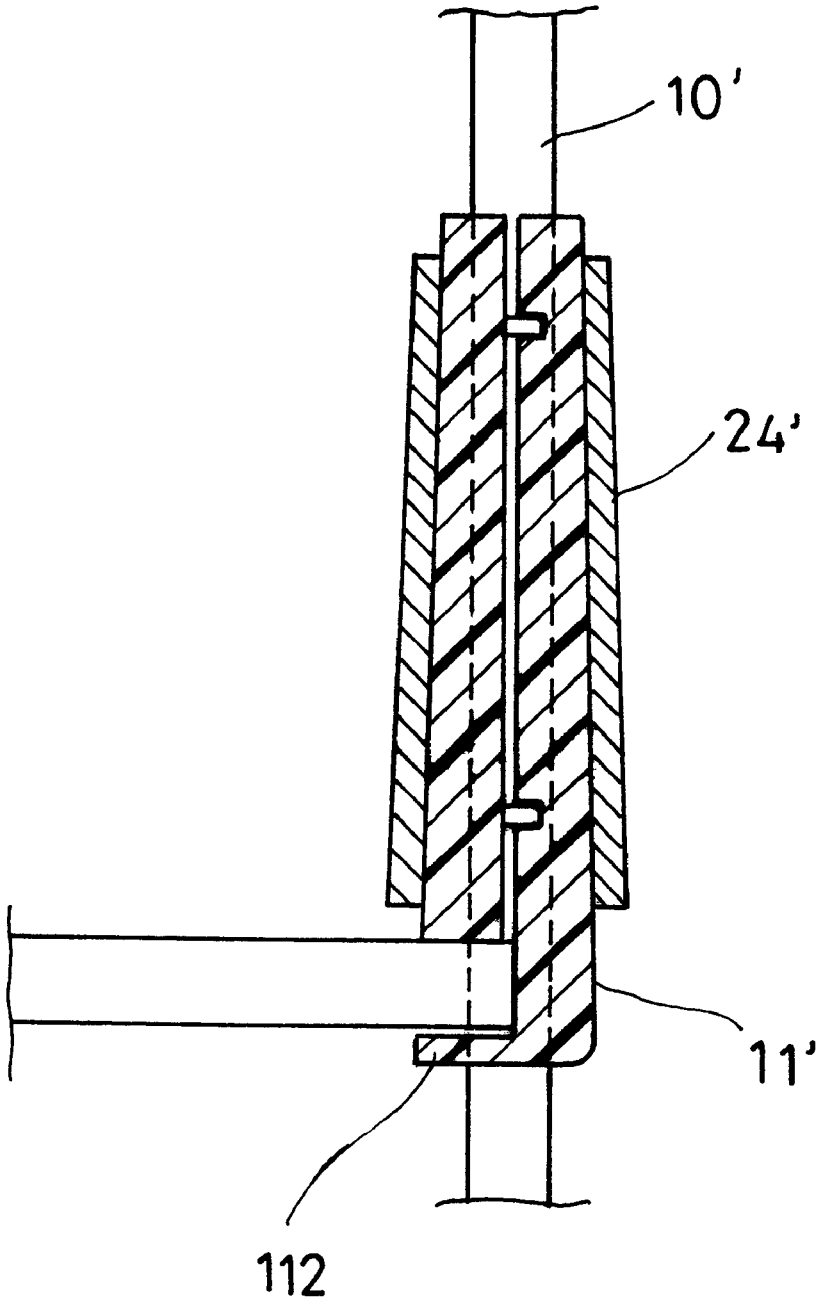
FIG. 11 is a vertical sectional view showing the shelf-holder, the connecting member, and the vertical post of FIG. 10 in an assembled state.

The two-part shelf-holder for sectional rack according to the present invention may have a differently designed configuration depending on profiles of the vertical post 10 and of the connecting member 11. FIGS. 10 and 11 illustrate a two-part shelf-holder according to a second embodiment of the present invention for use on a sectional rack having a vertical post 10' consisting of two parallel posts. In this case, the connecting member 11' includes two halves, each of which has two parallel recesses 111 corresponding to the two posts forming the vertical post 10'; and a case 24' on the fixed part 21' and a cover on the movable part of the shelf-holder the present invention together provide a sleeve having a substantially elliptic cross section corresponding to that of the connecting member 11'. In this case, a projection 112 is provided at a lower end of one of the two halves of the connecting member 11' for extending into a space between the two posts of the vertical post 10' and thereby locating the connecting member 11' in place relative to the vertical post 10'.

What is claimed is:

1. A two-part shelf-holder for a sectional rack including vertical posts on which connecting members having upward tapered outer surface are movably mounted for supporting shelves or horizontal supports of said sectional rack, said two-part shelf-holder comprising a fixed part and a movable part pivotally connected to said fixed part;

said fixed part including a horizontally extended arm portion adapted to fixedly connect at an inner end to an end of one said horizontal support or to a corner of one said shelf, and a curved case fixedly connected to an outer end of said arm portion; said curved case defining a side opening that has a width larger than an outer diameter of said vertical post;

said movable part being pivotally connected to said fixed part via a pivotal shaft, two ends of which being extended through a pair of through holes provided at upper and lower sides of said movable part to vertically and fixedly connect to upper and lower sides of said arm portion of said fixed part; said movable part including a forward extended curved cover adapted to cover said side opening of said curved case together with said curved case form a complete and closed sleeve for locating around and pressing said connecting member against said vertical post; and said two-part shelf-holder being characterized in that said two through holes provided on said movable part are lengthwise extended long holes to allow said movable part to move inward or outward relative to said fixed part and pivotally turn about said pivotal shaft, and that said cover of said movable part is formed at a free end with a dovetail tenon and said case of said fixed part is formed at a free end with a dovetail mortise corresponding to said dovetail tenon, so that said cover covers said side opening of said case with said dovetail tenon fitly engaging with said dovetail mortise.

2. A two-part shelf-holder for sectional rack as claimed in claim 1, wherein said long holes are so positioned and sized that when said movable part is moved with outer ends of said long holes that face toward said cover abutting on said pivotal shaft, said dovetail tenon on said movable part is moved into said dovetail mortise on said fixed part for said movable and said fixed parts to form a closed shelf-holder, and when said movable part is moved with inner ends of said long holes that face away from said cover abutting on said pivotal shaft, said dovetail tenon is sideward moved out of said dovetail mortise for said movable part to turn away from said fixed part and thereby open said closed shelf-holder.

* * * * *